US008396648B2

(12) United States Patent
Stolz et al.

(10) Patent No.: US 8,396,648 B2
(45) Date of Patent: Mar. 12, 2013

(54) METHOD FOR REGULATING THE COMBUSTION POSITION IN AN INTERNAL COMBUSTION ENGINE

(75) Inventors: Michael Stolz, Graz (AT); Alois Danninger, Kapfenberg (AT); Klemens Neunteufl, Graz (AT)

(73) Assignee: AVL List GmbH, Graz (AT)

( * ) Notice: Subject to any disclaimer, the term of this patent is extended or adjusted under 35 U.S.C. 154(b) by 426 days.

(21) Appl. No.: 12/733,684

(22) PCT Filed: Aug. 26, 2008

(86) PCT No.: PCT/EP2008/061122

§ 371 (c)(1),
(2), (4) Date: May 20, 2010

(87) PCT Pub. No.: WO2009/037070

PCT Pub. Date: Mar. 26, 2009

(65) Prior Publication Data

US 2010/0241334 A1 Sep. 23, 2010

(30) Foreign Application Priority Data

Sep. 13, 2007 (AT) ..... A 1437/2007

(51) Int. Cl.
*F02M 7/28* (2006.01)

(52) U.S. Cl. ..... 701/111; 123/435

(58) Field of Classification Search ..... 701/102–105, 701/110–111; 123/435–436; 73/35.12, 114.16
See application file for complete search history.

(56) References Cited

U.S. PATENT DOCUMENTS

| | | | | |
|---|---|---|---|---|
| 4,846,128 | A | 7/1989 | Yagi et al. | |
| 7,366,605 | B2 | 4/2008 | Schueler et al. | |
| 7,506,536 | B2 | 3/2009 | Cornwell et al. | |
| 7,527,034 | B2 * | 5/2009 | Gaertner | 123/305 |
| 7,761,219 | B2 * | 7/2010 | Loeffler et al. | 701/103 |
| 2006/0293829 | A1 * | 12/2006 | Cornwell et al. | 701/114 |
| 2009/0182485 | A1 * | 7/2009 | Loeffler et al. | 701/103 |

FOREIGN PATENT DOCUMENTS

| | | |
|---|---|---|
| AT | 502440 | 3/2007 |
| AT | 503061 | 7/2007 |
| EP | 2 075 442 A1 * | 7/2009 |
| GB | 2331154 | 5/1999 |

* cited by examiner

*Primary Examiner* — Hai Huynh
(74) *Attorney, Agent, or Firm* — Dykema Gossett PLLC

(57) ABSTRACT

A method for the closed-loop control of the combustion position in an internal combustion engine with several cylinders, especially in a diesel engine, with at least one engine operating parameter being detected, wherein a cylinder-selective combustion position model which is arithmetic or based on characteristic values is provided which produces a relationship between at least one determined engine operating parameter and the combustion position, and the combustion position is determined on the basis of the determined engine operating parameter by the combustion position model for each cylinder.

9 Claims, 1 Drawing Sheet

METHOD FOR REGULATING THE COMBUSTION POSITION IN AN INTERNAL COMBUSTION ENGINE

BACKGROUND OF THE INVENTION

1. Field of the Invention

The invention relates to a method for the closed-loop control of the combustion position in an internal combustion engine with several cylinders, especially in a diesel engine, with at least one engine operating parameter being detected.

2. The Prior Art

A system for controlling the ignition point in an internal combustion engine is known from EP 0 203 617 A2, with a cylinder pressure measurement being performed in at least one cylinder for detecting knocking phenomena and a combustion position in a closed loop is controlled on the basis of the measured cylinder pressure.

DE 10 2006 001 374 A1 describes an apparatus and a method for the open-loop and/or closed-loop control of an internal combustion engine, especially an internal combustion engine with direct injection. Closed-loop control will adjust a combustion position quantity which characterizes the combustion position to a setpoint value. An open-loop and/or closed-loop control will influence a torque variable characterizing the torque of the internal combustion engine and/or a noise variable characterizing the noise of the internal combustion engine by means of a control variable. This publication thus describes the arrangement of the closed-loop control of the combustion position, but not the calculation of the necessary input signals for the closed-loop control.

AT 503.061 A1 further discloses a method for the closed-loop control of combustion, especially in diesel engines, with the pressure being measured at least in one cylinder. In order to enable a precise closed-loop combustion control with the lowest possible effort, it is provided that according to the ignition sequence the cylinder pressure and the combustion position therefrom will be calculated only in every other cylinder and that the combustion position of the following cycle in this cylinder is controlled on the basis of the determined cylinder pressure and the combustion position in such a way that the actual cylinder pressure or the actual combustion position is adjusted to a setpoint value for the cylinder pressure or the combustion position. In cylinders in which the cylinder pressure is not measured, the cylinder pressure or combustion position is determined from the measured cylinder pressures, especially from a mean value of the measured cylinder pressures in the cylinder adjacent in the ignition sequence.

A method for the closed-loop control of the characteristic values of the combustion in an internal combustion engine is further known from AT 502.440 A2, with a fast control path which can act and measure during each injection and a slow control path which requires a substantially higher amount of time than the fast control path in a time raster being considered in the actuating behavior, and the effects on characteristic values of combustion and/or changes in at least one characteristic value of the fast control path being calculated from the quantity of the deviation between the actual values and the setpoint values of the slow control path.

It is the object of the invention to enable a precise closed-loop control of the combustion position in the simplest and most cost-effective manner.

SUMMARY OF THE INVENTION

This is achieved in accordance with the invention in such a way that a cylinder-selective combustion position model which is arithmetic or based on characteristic values is provided which produces a relationship between at least one determined engine operating parameter and the combustion position, and the combustion position is determined on the basis of the determined engine operating parameter by means of the combustion position model for each cylinder.

It is preferably provided that a preferably cylinder-selective combustion control signal is used as an engine operating parameter, especially preferably chosen from the group of injection duration, intervals to pre-injections and post-injections, injected quantity, injection pressure, injection period or the like. As an alternative to this or in addition it can be provided that a sensor signal of the engine sensor system is used as an engine operating parameter, preferably chosen from the group of speed, the drawn air mass, charging pressure, charging temperature, coolant temperature, fuel pressure, lambda sensor value.

The cylinder-selective combustion position model calculates a cylinder-selective "virtual" sensor value of the combustion position for each cylinder. It is used for closed-loop control of the combustion position. The combustion position model is based on a calculation which is based on signals available in the engine control. On the one hand, these are sensor signals from the standard engine sensor system such as speed, drawn air mass, charging pressure, charging temperature, coolant temperature, fuel pressure, lambda sensor value or the like. On the other hand, control signals are used which influence combustion such as injection time, time intervals between the main injection and the pre-injection or post-injection events, injection quantity, injection pressure or the like.

In order to enable a determination of the combustion position by means of a combustion model which is as realistic as possible, it is advantageous when the cylinder pressure is measured in at least one reference cylinder, preferably precisely in one reference cylinder, a reference combustion position is determined from the cylinder pressure signal, a model error is calculated on the basis of the difference between the reference combustion position of the reference cylinder determined from the cylinder pressure of the reference cylinder and the modeled combustion position of the combustion position model of the reference cylinder, and the combustion position model is corrected by the preferably filtered model error.

It is especially advantageous when a cylinder-selective closed-loop control of the combustion position is performed by means of the combustion position model.

BRIEF DESCRIPTION OF THE DRAWINGS

The invention is now explained below in greater detail by reference to the drawings, wherein.

DETAILED DESCRIPTION OF THE PREFERRED EMBODIMENT

Figure 1:
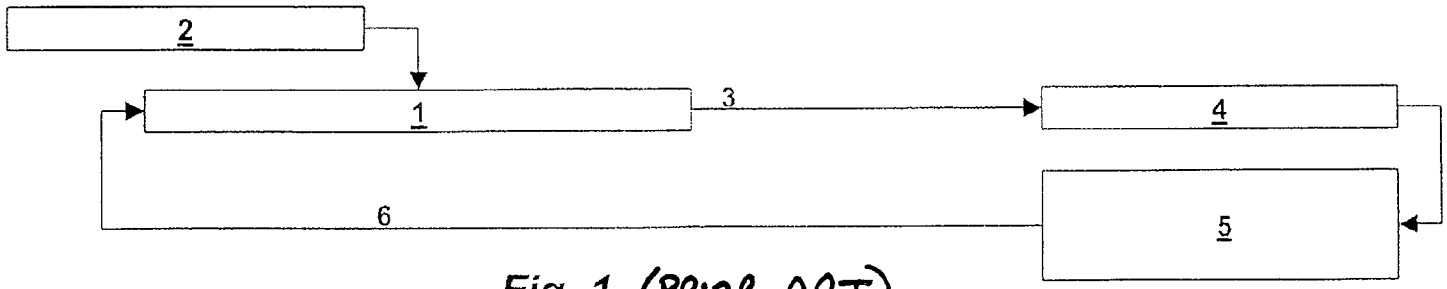
Fig. 1 (PRIOR ART)
FIG. 1 shows the closed-loop combustion position control according to the state of the art.

In the conventional closed-loop combustion position control as shown schematically in FIG. 1, an intervention 3 is performed in the combustion position on the basis of a desired combustion position 2 for a specific cylinder x (x=1, . . . n) as supplied to a combustion position controller 1, whereupon a combustion 4 occurs in cylinder x. The actual combustion position 6 is determined in a step 5 via a cylinder pressure sensor and supplied to the combustion position controller 1 as an actual value. In order to enable performing a precise closed-loop combustion position control for each cylinder x, a cylinder pressure sensor is required for each cylinder. When mean values of signals of adjacent cylinders are used, it is possible to reduce the number of required cylinder pressure sensors, but this occurs at the expense of the control quality.

Figure 2:
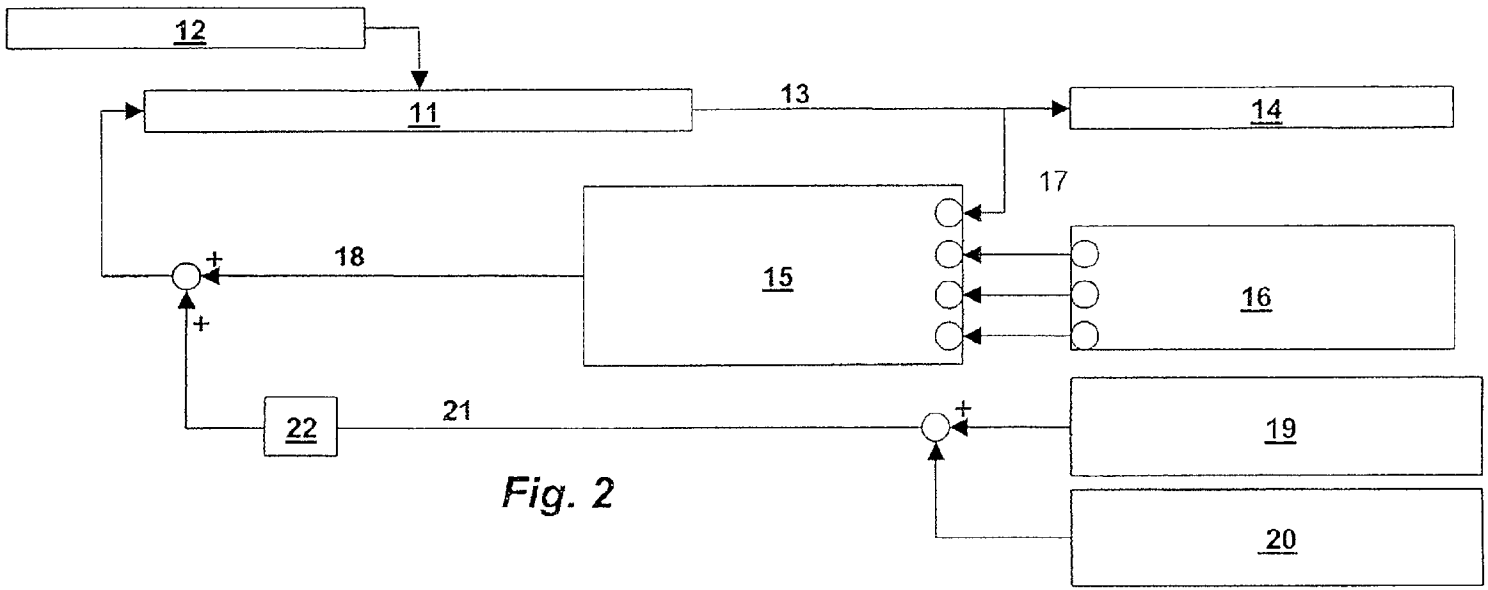
FIG. 2 shows a closed-loop combustion position control according to the invention.

FIG. 2 shows a closed-loop combustion position control in accordance with the invention.

The combustion position controller 11 performs an intervention 13 in the combustion position in a certain cylinder x on the basis of a desired combustion position 12, through which a combustion 14 occurs in the cylinder x. A combustion position model 15 for one or several cylinders x is now incorporated in accordance with the invention in the closed-loop combustion position control.

The combustion position model 15 receives various engine operating parameters as input quantities, which are sensor signals 16 from the standard sensor system of the engine control system on the one hand and control signals 17 of intervention 13 in the combustion position on the other hand, such as injection time, injection quantity, time intervals between pre-injection, main injection and post-injection, injection pressure, injection duration or the like. On the basis of the signals 16, 17, the combustion position model 15 determines a cylinder-specific fictitious combustion position 18. In the case of a respective calibration of the combustion position model 15, the fictitious combustion position can be supplied as information on the real combustion position to the closed-loop combustion position control 11 as an actual value. It is sufficient to calibrate the combustion position model 15 when the combustion position is determined by means of the cylinder pressure sensor in a reference cylinder. The reference combustion position is designated in FIG. 2 with reference numeral 19. The reference combustion position 19 is compared with a fictitious model-based combustion position 20 which is determined by the combustion position model. If there is a deviation between the real combustion position 19 determined by the cylinder pressure sensor and the model-based combustion position 20 for the reference cylinder, the fictitious combustion position 18 from the combustion position model 15 is corrected accordingly on the basis of the determined model error 21, with the signal of the model error 21 being additionally guided through a low-pass filter 22 so that only the middle model error 21 is corrected.

The necessary number of cylinder pressure sensors can be reduced substantially without any negative effect on the control quality by the method in accordance with the invention, so that considerable savings in cost can be achieved.

The invention claimed is:

1. A method for a closed-loop control of a combustion position in an internal combustion engine with several cylinders, with at least one engine operating parameter being detected, comprising:

providing a cylinder-selective combustion position model which is arithmetic or based on characteristic values which produces a relationship between at least one determined engine operating parameter and the combustion position, and determining the combustion position on the basis of the determined engine operating parameter by means of the combustion position model for each cylinder, wherein a cylinder pressure is measured in at least one reference cylinder and a reference combustion position is determined from the cylinder pressure signal, a model error is calculated on the basis of a difference between the reference combustion position of the reference cylinder determined from the cylinder pressure of the reference cylinder and the modeled combustion position of the combustion position model of the reference cylinder, and the combustion position model is corrected by the model error.

2. The method according to claim 1, wherein a sensor signal of a engine sensor system is used as an engine operating parameter.

3. The method according to claim 2, wherein the sensor signal is chosen from the group of speed, drawn air mass, charging pressure, charging temperature, coolant temperature, fuel pressure, lambda sensor value.

4. The method according to claim 1, wherein the control signal is used as an engine operating parameter.

5. The method according to claim 4, wherein the control signal is a cylinder-selective control signal.

6. The method according to claim 4, wherein the engine operating parameter is chosen from the group of injection time, intervals to pre-injections and post-injections, injected quantity, injection pressure, injection period.

7. The method according to claim 1, wherein the cylinder pressure is measured precisely in one reference cylinder.

8. The method according to claim 1, wherein the combustion position model is corrected by the filtered model error.

9. The method according to claim 1, wherein a cylinder-selective closed-loop control of the combustion position is performed by means of the combustion position model.

* * * * *

UNITED STATES PATENT AND TRADEMARK OFFICE

CERTIFICATE OF CORRECTION

PATENT NO. : 8,396,648 B2
APPLICATION NO. : 12/733684
DATED : March 12, 2013
INVENTOR(S) : Stolz et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 492 days.

Signed and Sealed this
First Day of September, 2015

Michelle K. Lee

Michelle K. Lee
*Director of the United States Patent and Trademark Office*